United States Patent [19]

Honma et al.

[11] 4,371,397

[45] Feb. 1, 1983

[54] CHEMICAL COPPER-PLATING BATH

[75] Inventors: Hideo Honma, Yokohama; Kunihiro Ikari, Yokosuka; Osamu Sasaki, Sagamihara; Toshiki Sasabe, Tokyo; Kazuhiro Takeda; Tsutomu Takamura, both of Yokohama, all of Japan

[73] Assignee: Tokyo Shibaura Denki Kabushiki Kaisha, Kawasaki, Japan

[21] Appl. No.: 212,998

[22] Filed: Dec. 4, 1980

[30] Foreign Application Priority Data

May 8, 1980 [JP] Japan ..... 55-59962

[51] Int. Cl.[3] ..... C23C 3/02

[52] U.S. Cl. ..... 106/1.23; 106/1.26; 427/437; 427/443.1

[58] Field of Search ..... 106/1.23, 1.26; 427/437, 443.1

[56] References Cited

U.S. PATENT DOCUMENTS 3,457,089 7/1969 Shipley et al. ..... 106/1.26
3,607,317 9/1971 Schneble ..... 106/1.26
3,661,597 5/1972 Gulla ..... 106/1.26
3,804,638 4/1974 Jonker et al. ..... 106/1
4,002,786 1/1977 Hirohata et al. ..... 106/1.26

*Primary Examiner*—Lorenzo B. Hayes

*Attorney, Agent, or Firm*—Schwartz, Jeffery, Schwaab, Mack, Blumenthal & Koch

[57] ABSTRACT

There is presented a chemical copper-plating bath capable of providing a plated film having excellent mechanical characteristics, especially ductility, which bath contains a specific additive having the following formula:

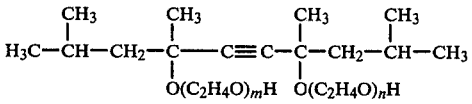

Stability of the bath as well as further improvement of mechanical strength of plated films are also found to be attained by adding in combination at least one compound selected from the group consisting of 1,10-phenanthroline, its derivatives, 2,2'-dipyridyl, 2,2'-diquinoline and water-soluble cyanides.

6 Claims, No Drawings

CHEMICAL COPPER-PLATING BATH

BACKGROUND OF THE INVENTION

This invention relates to a chemical copper-plating bath, particularly a chemical copper-plating bath capable of providing a plated film having excellent mechanical characteristics.

A chemical copper-plating bath generally contains a copper salt such as copper sulfate, cupric chloride, etc., a complex-forming agent such as ethylenediamine tetraacetate, N,N,N',N'-tetrakis-(2-hydroxypropyl)ethylenediamine, etc., a reducing agent such as formaldehyde and a pH controller such as sodium hydroxide, etc. Such a chemical copper-plating bath containing these components alone can give a plated film which is generally brittle and has only insufficient mechanical characteristics, especially poor ductility, for practical application. For example, according to the so called additive method, in which a current passage circuit portion is formed by chemical copper-plating on a printed circuit plate, circuit breaking is liable to occur due to processing of printed circuits, thermal strain caused by environmental changes or physical impact.

In order to improve the above drawbacks, there have been attempts to improve ductility of a chemically deposited copper film by adding polyethylene glycol, dipyridyls, phenanthrolines or water-soluble cyanides to a chemical copper-plating bath comprising a copper salt, a complex-forming agent, a reducing agent and a pH controller. However, even if the above dipyridyls may be added, improvement in ductility of the chemically deposited copper film is very slight, and the mechanical characteristics attained are still insufficient for practical application, for example, as a copper film for forming the current passage circuit in printed circuits.

SUMMARY OF THE INVENTION

The object of the present invention is to provide a chemical copper-plating bath capable of providing a plated film excellent in mechanical characteristics, especially ductility, by overcoming the drawbacks as mentioned above.

One of the chemical copper-plating baths provided by the present invention comprises a copper salt, a complex-forming agent, a reducing agent and a pH controller, wherein the improvement comprises incorporating a nonionic surfactant represented by the formula:

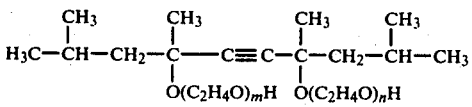

(I)

wherein m and n are integers of 1 or more, and $m+n \geqq 12$. The other chemical copper-plating bath provided by the present invention comprises a copper salt, a complex-forming agent, a reducing agent and a pH controller, wherein the improvement comprises incorporating (1) a nonionic surfactant represented by the above formula (I) and (2) at least one compound selected from the group consisting of 1,10-phenanthroline, 1,10-phenanthroline derivatives, 2,2'-dipyridyl, 2,2'-biquinoline and water-soluble cyanides.

DESCRIPTION OF THE PREFERRED EMBODIMENTS

The nonionic surfactants of the formula (I) which can effectively be used for improvement of mechanical characteristics, especially ductility, of chemically deposited copper films are those wherein $m+n \geqq 12$. If $m+n<12$, the solubility of the nonionic surfactants is too small and hence it is very difficult to add such surfactants in amounts sufficient for improvement of ductility of the plated films. As the value of $m+n$ is increased, there tends to be an increase of the mechanical strength of the plated film such as ductility. At around $m+n=20$, the mechanical strength reaches its maximum and there is no more improvement of the mechanical strength by increasing $m+n$ to a higher value. The upper limit of $m+n$ is not specifically limited from the standpoint of improving ductility of plated films. In view of handling of materials, however, it is preferred that $m+n$ should be not more than 500. The surfactant of the formula (I) may be added generally in an amount of 3 mg/liter to 30 g/liter. In particular, when $m+n<20$, an amount in the range from 50 mg/liter to 10 g/liter is preferred; while, when $m+n \geqq 20$, it is preferred to use an amount in the range from 10 mg/liter to 2 g/liter. To evaluate comprehensively the surfactants of the formula (I) by taking effectiveness in improvement of mechanical properties such as ductility as well as handling of materials as mentioned above into consideration, it is preferred to use those wherein $m+n$ is in the range from 20 to 500.

As described above, there can be obtained chemically plated copper films having excellent mechanical properties, typically ductility, by addition of the surfactants of the formula (I).

When at least one compound selected from the group consisting of 1,10-phenanthroline, 1,10-phenanthroline derivatives, 2,2'-dipyridyls, 2,2'-biquinoline and water-soluble cyanides is added to the copper plating bath in addition to the nonionic surfactants of the formula (I), not only the mechanical properties such as ductility of the plated films can be further increased, but also stability of the plating bath can be improved. In the prior art, there was an attempt to improve ductility of plated films by addition of phenanthroline to a plating bath. But there can be obtained only an insufficient effect as previously mentioned. Whereas, by using a combination of the nonionic surfactant of the formula (I) with 1,10-phenanthroline, the effect of improvement of ductility by addition of the nonionic surfactant of the formula (I) can further be increased. Moreover, an additional effect hitherto unknown is also found to be achieved. That is, stability of the plating bath can be improved to make it more useful in practical applications.

The amount of 1,10-phenanthroline, 1,10-phenanthroline derivatives, 2,2'-dipyridyl or 2,2'-biquinoline may preferably be in the range from 2 to 200 mg/liter, more preferably from 5 to 50 mg/liter. Generally speaking, with an amount less than 2 mg/liter, there can be expected no appreciable improvement of ductility. On the other heand, addition of such a compound in excess of 200 mg/liter is not only meaningless, because the effect of improvement of ductility has already reached its saturation, but may also cause spontaneous decomposition of the plating bath due to abrupt increase in copper deposition speed.

As the 1,10-phenanthroline derivatives to be used in the present invention, there may be mentioned, for example, 2,9-dimethyl-1,10-phenanthroline, 4,7-diphenyl-2,9-dimethyl-1,10-phenanthroline, 4,7-diphenyl-1,10-phenanthroline, thus including 1,10-phenanthroline derivatives having substituents such as lower alkyl groups, e.g., methyl group, ethyl group, etc., and phenyl group.

Water-soluble cyanides may be inclusive of potassium cyanide, sodium cyanide, sodium nitroprusside, potassium ferrocyanate, potassium ferricyanate, potassium tetracyanonickelate, and so forth. Such a water-soluble cyanide may be added in an amount preferably in the range from 2 mg/liter to 3 g/liter, more preferably from 5 mg/liter to 1 g/liter. This is because no effect of improvement of stability and mechanical strength can be attained with an amount less than 2 mg/liter, while an amount exceeding the upper limit is meaningless, since the aforesaid effect has reached its saturation, and may moreover cause spontaneous decomposition of the plating bath due to abrupt increase of copper depositing speed.

As apparently seen from the foregoing description as well as from the following Examples, the plating bath according to the present invention containing the nonionic surfactants represented by the formula (I) can give plated films excellent in mechanical characteristics, typically ductility, which are sufficiently useful in practical applications. Further, when a compound such as 1,10-phenanthroline or others is used together with the aforesaid nonionic surfactant, stability of the plating bath can also be improved simultaneously with further improvement of mechanical characteristics.

The chemical copper-plating bath according to the present invention may preferably be used under the treatment conditions of a temperature ranging from 50° to 80° C., more preferably from 60° to 70° C., a pH from 10.8 to 13.0, more preferably from 12.0 to 12.5. Under such plating conditions, the characteristics of the plating bath of the present invention can sufficiently be exhibited, whereby plated films enriched in ductility can be obtained.

The present invention is further illustrated by referring to the following Examples.

EXAMPLES 1-12, COMPARATIVE EXAMPLES 1-4

A rolled copper foil with thickness of 10 μm was immersed in an aqueous 10% sodium hydroxide at room temperature for 30 seconds. After washing with water, the copper foil was immersed in 10% nitric acid at room temperature for 5 seconds. Then, the surface of the copper foil was cleaned by washing with water. As the next step, the above copper foil was immersed in a solution having the following composition for two minutes:

Stannous chloride (II): 50 g/liter
Hydrochloric acid: 10 ml/liter
Water: Remainder.

The treated foil was washed with water in running water for one minute. Then, the foil was immersed in a solution having the composition shown below for one minute:

Palladium chloride: 0.25 g/liter
Hydrochloric acid: 10 ml/liter
Water: Remainder, followed by washing with running water for one minute. Subsequently, there was prepared a solution having the following composition:

Copper sulfate (5 hydrate): 12.5 g/liter
Ethylenediamine tetraacetate tetrasodium salt: 15 g/liter
Para-formaldehyde: 4.5 g/liter
Water: Remainder.

To each one liter of this solution, there was added each of the additives as indicated in the Table in prescriptions as shown in the same Table to prepare each chemical copper-plating bath to be used for the respective Examples and Comparative examples. By use of these chemical copper-plating baths, plated films with thickness from 4 to 6 μm were precipitated on the surface and reverse side of the copper foils with thickness of 10 μm which had been made up for catalysts in the manner as described above. The plating was effected under the conditions of the plating temperature of 70° C. and the pH of 12.3.

The thus obtained plated films were subjected to a ductility test. The ductility was determined by the 180° - folding test as follows. Namely, the plated film was first bent in one direction over 180°, folded and bent back in its original position whereafter the fold is flattened under pressure. This completes one bend. The operations are repeated until the film breaks and thus it is possible to express the ductility in the number of bends which the film can stand. The results of the ductility tests are also shown in the same Table.

TABLE

| | Bath composition (mg/liter) | | | | | | | |
|---|---|---|---|---|---|---|---|---|
| | Surfactants | | | | | | | |
| | Species | Content | 2,2'-dipyridyl | 2,9-dimethyl-1,10-phenanthroline | Potassium cyanide | Potassium tetracyanonickelate | Sodium nitroprusside | Bends |
| Examples: | | | | | | | | |
| 1 | A(m + n = 12) | 1250 | — | — | — | — | — | 18 |
| 2 | B(m + n = 30) | 500 | — | — | — | — | — | 20 |
| 3 | C(m + n = 50) | 250 | — | — | — | — | — | 21 |
| 4 | D(m + n = 100) | 100 | — | — | — | — | — | 21 |
| 5 | C(m + n = 50) | 250 | 20 | — | — | — | — | 22 |
| 6 | " | 250 | — | 20 | — | — | — | 22 |
| 7 | " | 50 | — | — | 10 | — | — | 21 |
| 8 | " | 1000 | 10 | — | — | — | 7.5 | 22 |
| 9 | " | 50 | 5 | — | — | 75 | — | 23 |
| 10 | " | 250 | 20 | — | 5 | — | — | 25 |
| 11 | " | 250 | 20 | 30 | — | — | — | 26 |
| 12 | " | 250 | 20 | 30 | 20 | — | — | 26 |
| Comparative examples: | | | | | | | | |
| 1 | — | — | 10 | — | — | — | — | 10 |

TABLE-continued

| | Bath composition (mg/liter) | | | | | | | |
|---|---|---|---|---|---|---|---|---|
| | Surfactants | | 2,2'-dipyridyl | 2,9-dimethyl-1,10-phenanthroline | Potassium cyanide | Potassium tetracyanonickelate | Sodium nitroprusside | Bends |
| | Species | Content | | | | | | |
| 2 | — | — | — | 50 | — | — | — | 10 |
| 3 | — | — | — | — | 10 | — | — | 7 |
| 4 | PEG 4000*1 | 250 | — | — | — | — | — | 15 |

*1PEG 4000: polyethylene glycol (average molecular weight: 4,000)

We claim:

1. In a chemical copper-plating bath, comprising a copper salt, a complex-forming agent, a reducing agent and a pH controller, the improvement which comprises a nonionic surfactant represented by the formula:

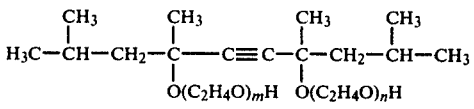

wherein m and n are integers of 1 or more, and $m+n \geqq 12$, and at least one compound selected from the group consisting of 2,9-dimethyl-1,10-phenanthroline and 2,2'-dipyridyl in amounts effective to improve the ductility of copper films produced from the bath.

2. A chemical copper-plating bath according to claim 1, wherein m+n is in the range from 20 to 500.

3. A chemical copper-plating bath according to claim 2, wherein the nonionic surfactant is contained in an amount of 10 mg/liter to 2 g/liter.

4. A chemical copper-plating bath according to claim 1, wherein said compound is present in an amount of from about 2 to 200 mg/liter.

5. A chemical copper-plating bath according to claim 1, wherein m+n is 50 or greater.

6. A chemical copper-plating bath according to claim 5, wherein the bath contains a mixture of 2,2'-dipyridyl and 2,9-dimethyl-1,10-phenanthroline.

* * * * *